United States Patent [19]

Ohata

[11] Patent Number: 4,860,707

[45] Date of Patent: Aug. 29, 1989

[54] NON-LINEAR FEEDBACK CONTROLLER FOR INTERNAL COMBUSTION ENGINE

[75] Inventor: Akira Ohata, Mishima, Japan

[73] Assignee: Toyota Jidosha Kabushiki Kaisha, Aichi, Japan

[21] Appl. No.: 174,962

[22] Filed: Mar. 29, 1988

[30] Foreign Application Priority Data

Apr. 21, 1987 [JP] Japan ..... 62-98344

[51] Int. Cl.[4] ..... F02D 41/16

[52] U.S. Cl. ..... 123/339; 123/341; 123/352

[58] Field of Search ..... 123/339, 340, 341, 350, 123/352, 587

[56] References Cited

U.S. PATENT DOCUMENTS

| | | | |
|---|---|---|---|
| 4,305,360 | 12/1981 | Meyer et al. | 123/339 |
| 4,492,195 | 1/1985 | Takahashi et al. | 123/339 |
| 4,653,449 | 3/1987 | Kamei et al. | 123/339 |
| 4,658,783 | 4/1987 | Janetzke et al. | 123/339 |
| 4,667,632 | 5/1987 | Shimomura et al. | 123/340 |
| 4,709,674 | 12/1987 | Bianchi et al. | 123/339 |

FOREIGN PATENT DOCUMENTS 59-7751 1/1984 Japan .

*Primary Examiner*—Andrew M. Dolinar
*Attorney, Agent, or Firm*—Kenyon & Kenyon

[57] ABSTRACT

A single physical model which receives inputs of at least the intake pressure and rotational speed of an internal combustion engine and which produces an output which controls an opening area of an intake passage is developed for a controller to control the idling speed or the output of the internal combustion engine on the basis of modern control theory. When the intake pressure is equal to or less than a predetermined value (critical pressure), the flow velocity of air which is sucked into a cylinder is fixed at sonic velocity, irrespective of changes in the level of the intake pressure, so the quantity of intake air is proportional to the opening area of the intake passage. Under these conditions, a manipulating quantity for controlling the opening area is determined by multiplying a control quantity outputted from the controller by a predetermined constant. On the other hand, when the intake pressure exceeds the critical pressure, the quantity of air flowing into the cylinder changes in accordance with the difference between the intake pressure and the atmospheric pressure. In that case a manipulating quantity is determined by compensating the control quantity in accordance with the pressure difference.

7 Claims, 8 Drawing Sheets

NON-LINEAR FEEDBACK CONTROLLER FOR INTERNAL COMBUSTION ENGINE

BACKGROUND OF THE INVENTION

The present invention relates to a non-linear feedback controller for an internal combustion engine which is effective in stably controlling the rotational speed of the internal combustion engine or in controlling the engine speed so as to converge to a target rotational speed with superior follow-up characteristics by using a parameter which is determined on the basis of a dynamic physical model of the internal combustion engine.

A technique has heretofore been known by which a dynamic model of an internal combustion engine is constructed on the basis of a control theory that takes into consideration the internal state of the engine, and a variable which is to be input to the internal combustion engine to be controlled is determined by estimating a dynamic behavior of the engine on the basis of state variables which represents the internal state of the engine. One example of such technique has been proposed as a "Method of Simultaneously Controlling Idling Speed and Air-Fuel Ratio in Internal Combustion Engine" (Japanese Patent Laid-Open No. 59-7751). More specifically, state variables of appropriate order which represent the dynamic internal state of an internal combustion engine are estimated on the basis of a dynamic model of the engine in which control inputs include the air quantity, the fuel supply quantity and the ignition timing or the exhaust recirculating quantity; control outputs include the idling speed and the air-fuel ratio; and a multi-variable control is effected with the above-described control inputs and outputs. In particular, when there is a change in the dynamics of the engine, the dynamic model and control gain are changed for appropriate other ones, thereby simultaneously effecting optimal control of the rotational speed and air-fuel ratio during idling of the engine in accordance with the dynamics of the engine, and thus realizing even more stable idling.

In this prior art, the state variables are not required to correspond to various kinds of physical quantities which represent the actual internal state, but these variables generally simulate the engine. Further, according to the above-described prior art, a parameter (e.g., cooling water temperature) is determined in order to detect the fact that there is a change in the dynamics of the engine, and dynamic models are stored in advance in correspondence with various values of the parameter, so that the dynamic models and control gains are changed from one to another in accordance with the value of the parameter.

In regard to a complicated control object such as an internal combustion engine, it has heretofore been difficult to obtain theoretically a precise dynamic model of such a complex control object, and therefore has been necessary to determine the model experimentally in some way. Accordingly, in the above-described prior art, the relationship between each control input and control output is expressed by a transfer function matrix which has been obtained in the vicinity of a certain reference set value and then linearly extrapolated, and the transfer function matrix is determined by the so-called system identification technique, thereby constructing a dynamic model of the internal combustion engine. However, the dynamic model thus determined expresses the behavior of the internal combustion engine for perturbations only in the vicinity of a specific operating condition, that is, near the above-described reference set value, and it is a model which does not necessarily have physical meanings. Therefore, in general, the dynamic model does not effectively match the internal combustion engine that is the control object.

Thus, when the operating condition of the internal combustion engine changes over a wide range, that is, when the engine is frequently run in transient states at the time, for example, of cold starting, warming-up, idling after the completion of warming-up, heavy-load operation during starting or acceleration, and light-load operation during constant-speed running, the actual behavior of the internal combustion engine deviates from the predetermined dynamic model to a substantial extent, resulting in a reduced degree of control accuracy. Accordingly, it has heretofore been difficult to effect satisfactory feedback control.

To overcome such a problem, the above-described prior art is arranged such that a plurality of linear models are determined, corresponding to various operating conditions of an internal combustion engine, and these linear models are changed from one to another to effect accurate control. The predetermination of a plurality of linear models complicates the control law, however, and leads to poorer control response and follow-up characteristics. Moreover, when control is effected at the boundary region between linear models, it is impossible to predict what kind of phenomenon will occur.

To cope with the above-described problem, the applicant of this application has already proposed, for example, "Feedback Control Method for Internal Combustion Engine" (Japanese Patent Application No. 61-220687). In this proposed method, a control quantity for feedback control is determined on the basis of formula models obtained by making discrete samples of a dynamic physical model of an internal combustion engine by means of sampling effected every predetermined crank angle, the dynamic physical model being constructed using at least a quantity which is equivalent to the pressure of intake air sucked into the engine and a quantity which is equivalent to the rotational speed of the engine. This eliminates the need to change the control law even when the operating condition of the internal combustion engine changes over a wide range. In this improved art, the dynamic physical model of the internal combustion engine is based on the assumption that the quantity of air passing through the throttle valve is independent of the intake pressure and proportional only to the opening area of the intake passage.

Subsequent research has determined that when the intake pressure is equal to or less than the critical pressure (for example, if the intake pressure P is 53.7 KPa or less when the atmospheric pressure PO (at the upstream side of the throttle valve) is 101.32 KPa), that is, when the engine is run under a relatively light load with a relatively small throttle valve opening, the flow velocity of the intake air when passing the vicinity of the throttle valve has a constant value which is substantially equal to the velocity of sound, and the above-described assumption is valid. However, when the intake pressure exceeds the critical pressure, that is, when the engine is run under a relatively heavy load with a relatively large throttle valve opening, the flow velocity of the intake air passing the vicinity of the throttle valve changes under the effect of the intake pressure, and the above-described assumption is not necessarily valid. Accordingly, in the case where the behavior of the internal combustion engine expressed by the dynamic physical model differs from the actual dynamic behavior of the engine during a heavy-load running at the time, for example, of starting or acceleration, the degree of control accuracy may fall, which means that the abovedescribed improved art is still unsatisfactory.

SUMMARY OF INVENTION

It is a primary object of the present invention to provide a non-linear feedback controller for an internal combustion engine which is capable of controlling the rotational speed of the engine with a high degree of accuracy using a single control law based on a dynamic physical model of the internal combustion engine which effectively conforms with various operating conditions of the engine.

To this end, the present invention provides a non-linear feedback controller for an internal combustion engine which, as shown in FIG. 1, determines a control quantity which is feedback-input to the internal combustion engine M1 according to a dynamic physical model of the internal combustion engine M1 which is obtained by approximation from an equation of motion of the internal combustion engine M1 and a mathematical formula expressing mass conservation of the quantity of intake air sucked into the internal combustion engine M1, thereby controlling the rotational speed of the internal combustion engine M1, the controller comprising:

operating condition detecting means M2 for detecting at least an intake pressure equivalent quantity which is equivalent to an intake pressure of the internal combustion engine M1 and a rotational speed equivalent quantity which is equivalent to a rotational speed of the internal combustion engine M1;

opening area controlling means M3 for controlling the opening area of an intake passage of the internal combustion engine M1 in accordance with an external command manipulating quantity;

control means M4 for calculating a control quantity concerned with the control of the opening area of the intake passage of the internal combustion engine M1 from at least the intake pressure equivalent quantity and rotational speed equivalent quantity detected by the operating condition detecting means M2 by using a parameter set on the basis of the dynamic physical model of the internal combustion engine M1; and compensating means M5 for outputting a manipulating quantity to the opening area controlling means M3 in such a manner that, when the intake pressure equivalent quantity detected by the operating condition detecting means M2 is equal to or less than a critical pressure equivalent quantity, a value which is determined on the basis of the control quantity calculated by the control means M4 and a predetermined constant is defined as a manipulating quantity; whereas, when the intake pressure equivalent quantity exceeds the critical pressure equivalent quantity, a value obtained by compensating the control quantity in accordance with the intake pressure equivalent quantity is defined as a manipulating quantity.

The operating condition detecting means M2 detects at least an intake pressure equivalent quantity which is equivalent to an intake pressure in the internal combustion engine M1 and a rotational speed equivalent quantity which is equivalent to a rotational speed of the engine M1. The intake pressure equivalent quantity includes various quantities which have a predetermined relationship with the pressure within the intake pipe. It should be noted that the pressure which is to be detected is either a relative pressure or an absolute pressure (a pressure measured relative to a vacuum which is assumed to be 0). The rotational speed equivalent quantity includes various quantities in addition to the rotational speed of the engine M1, for example, a rotational speed square value, a rotational angular velocity, or a quantity which is uniquely determined in accordance with the rotational speed of the engine M1.

In the case where, for example, the pressure within the intake pipe is detected as an intake pressure equivalent quantity, the operating condition detecting means M2 may be realized by an intake pressure sensor (vacuum sensor) or the like defined by a semiconductor pressure sensor which is disposed in the intake passage of the internal combustion engine M1 at the downstream side of the throttle valve.

In the case where the rotational speed of the engine M1 is detected as a rotational speed equivalent quantity, the operating condition detecting means M2 may comprise, for example, a rotational speed sensor consisting of a pulse gear which is secured to the camshaft of a distributor or a cam position sensor of the internal combustion engine M1 and an electromagnetic pickup which is disposed in close proximity with and in opposing relation to the pulse gear.

The operating condition detecting means M2 may also be defined by, for example, a rotational speed sensor which detects the rotational speed of the crankshaft of the internal combustion engine M1. In the case where a rotational speed square value is detected as a rotational speed equivalent quantity, the operating condition detecting means M2 may comprise, for example, one of the abovedescribed rotational speed sensors, an F/V converter which converts a pulse signal output from the rotational speed sensor into an analog signal, and a multiplier which squares the analog signal. It is also possible to obtain a rotational speed square value by inputting the abovedescribed pulse signal into a logical arithmetic circuit and processing it according to a predetermined procedure.

Further, the operating condition detecting means M2 may comprise, in addition to the above-described intake pressure sensor and rotational speed sensor, an atmospheric pressure sensor for measuring an atmospheric pressure and an intake air temperature sensor for measuring the temperature of the intake air, the atmospheric pressure sensor and the intake air temperature sensor being disposed in the intake passage of the internal combustion engine M1 at the upstream side of the throttle valve.

The opening area controlling means M3 controls the opening area of the intake passage of the internal combustion engine M1 in accordance with an external command manipulating quantity. The opening area controlling means M3 may be realized using a throttle valve (so-called linkless throttle) which controls the effective opening area of the intake pipe by pivoting in receipt of driving force supplied from an actuator, for example, a DC servomotor which operates in response to a direct current supplied from the outside, or a stepping motor which operates in response to a pulse signal transmitted thereto from the outside. The opening area controlling means M3 may also be defined by an idling speed control valve (so-called ISCV) which controls the effective opening area of a bypass which bypasses the throttle valve, the ISCV being activated by means of driving force supplied from an actuator, for example, the above-described stepping motor or a linear solenoid which is driven in response to a duty ratio signal transmitted thereto from the outside. Further, the opening area controlling means M3 may be arranged using, for example, an intake system which has both the above-described linkless throttle and ISCV.

The control means M4 calculates a control quantity concerned with the control of the opening area of the intake passage of the internal combustion engine M1 from at least the intake pressure equivalent quantity and rotational speed equivalent quantity detected by the operating condition detecting means M2 by using a parameter set on the basis of the dynamic physical model of the internal combustion engine M1.

The dynamic physical model of the internal combustion engine may be constructed as follows. First, a first approximate equation is obtained from the equation of motion of the internal combustion engine M1 which is in an operative state, the approximate equation expressing a rotational energy change per predetermined crank angle of the internal combustion engine M1 in the form of a linear combination of at least the intake pressure and load torque. Then, a second approximate equation is obtained from a mathematical formula which expresses mass conservation of the intake air quantity in that cylinder of the internal combustion engine M1 which is in the intake stroke, the second approximate equation expressing an intake pressure change per predetermined crank angle of the engine M1 in the form of a linear combination of at least the intake air quantity and intake pressure per predetermined crank angle. With the first and second approximate equations employed as identification fundamental equations, the coefficients of the identification fundamental equations are determined by the system identification technique, thus deducing the following state equation (1) and output equation (2):

$$X(k+1)=P\cdot X(k)+G\cdot u(k) \quad (1)$$

$$Y(k)=T\cdot X(k) \quad (2)$$

The above equations (1) and (2) are expressed in discrete systems, and the suffix k denotes the time of sampling. The state variable X(k) is a function of at least the rotational speed square value and intake pressure. The input u(k) includes at least the intake air quantity per predetermined crank angle (i.e., a control quantity concerned with the control of the intake air quantity). The output Y(k) is a function of at least the rotational speed square value and intake pressure. According to the equations (1) and (2) thus formulated, a dynamic physical model of the internal combustion engine M1 is determined.

The control means M4 may be realized as follows. For example, the control means M4 is arranged either as a regulator which effects so-called state feedback control in which a control quantity {for example, a quotient obtained from the intake air quantity divided by the rotational speed} is obtained by multiplying the state variable X(k) {for example, a function of the intake pipe pressure and rotational speed square value} by a feedback coefficient matrix, or as a so-called optimal regulator which obtains a control quantity by multiplying the above-described state variable X(k) by an optimal feedback gain, thus calculating an intake air quantity per predetermined crank angle. The control means M4 may also be arranged in the form of a so-called servo system wherein, in order to enable the rotational speed square value to follow up a target rotational speed square value in the presence of disturbances, a value which is obtained by multiplying a cumulative deviation (obtained by successively adding deviations of measured rotational speed square values from the target rotational speed square value) by the feedback coefficient matrix, or by that element in the optimal feedback gain which is concerned with the cumulative deviation, is added to the above-described control quantity to thereby calculate a final control quantity.

In the case where the control system includes a state variable which cannot be directly measured, the control means M4 may be arranged as a dynamic system which is provided with a so-called observer which estimates an immeasurable state variable from an output of a control object (the internal combustion engine M1 in the case of the present invention) which can be directly measured. There are known various kinds of observer, for example, a minimal order observer, an identity observer, a dead beat observer, a linear function observer, and an adaptive observer. These observers are described in detail, for example, in David G. Luenberger "Introduction to Dynamic Systems—Theory, Models and Applications", John Wiley & Sons, Inc., NY, 1979. In the case where it is difficult to effect state feedback control by directly measuring all the state variables, the control means M4 may be provided with, for example, a dynamic compensator which obtains a control law from the output to thereby effect output feedback. Various kinds of such dynamic compensators are described in detail, for example, in Takashi Tanihagi "Theory of Digital Signal Processing; 1: Basics, System and Control" (1985) Coronasha, Ltd., and Itataka Kamitaki et al. "Basics and Application of Control Theory" (1986) Ohmsha, Ltd.

The compensating means M5 outputs a manipulating quantity to the opening area controlling means M3 in such a manner that when the intake pressure equivalent quantity detected by the operating condition detecting means M2 is equal to or less than a critical pressure equivalent quantity, a value which is determined on the basis of the control quantity calculated by the control means M4 and a predetermined constant is defined as a manipulating quantity; whereas, when the intake pressure equivalent quantity exceeds the critical pressure equivalent quantity, a value obtained by compensating the control quantity in accordance with the intake pressure equivalent quantity is defined as a manipulating quantity. For example, when the intake pipe pressure is equal to or less than the critical pressure, the flow velocity of air sucked into that cylinder of the internal combustion engine M1 which is in the intake stroke is equal to sonic velocity. Therefore, the intake air quantity is proportional to the opening area of the intake passage. Accordingly, it is possible to determine a manipulating quantity on the basis of the control quantity and a predetermined constant.

It should be noted that the predetermined constant is a value which is calculated on the assumption that, for example, the atmospheric pressure and the intake air temperature are constant. When the intake pipe pressure exceeds the critical pressure, the flow velocity of air sucked into that cylinder of the internal combustion engine M1 which is in the intake stroke changes in accordance with the size relationship between the intake pipe pressure and the atmospheric pressure. Therefore, it is necessary to subject the control quantity to incremental or decremental compensation in accordance with the level of the intake pipe pressure.

Accordingly, the compensating means M5 may be arranged such that when a value obtained by dividing the intake pipe pressure by the atmospheric pressure is equal to or less than the critical pressure ratio (about 0.53 in the case of diatomic gases such as air), a manipulating quantity is calculated from the control quantity and the predetermined constant or from a predetermined map; whereas, when the value obtained by dividing the intake pipe pressure by the atmospheric pressure exceeds the critical pressure ratio, the control quantity is compensated in accordance with the level of the intake pipe pressure by the use of a mathematical formula obtained by modifying the energy equation of compressible fluid or a map which is equivalent to said mathematical formula. The flow of a compressible fluid inside a duct which is accompanied by a density change due to a pressure difference is described in detail, for example, in A. M. Kuethe and J. D. Schetzer, "Foundations of Aerodynamics", John Wiley & Sons, Inc. (1967) and in Horace Lamb, "Hydrodynamics 6 edition", Cambridge at the University Press (1932).

The above-described control means M4 and compensating means M5 are arranged in the form of a logical arithmetic circuit consisting of, for example, a CPU, ROM and RAM which are well-known, together with other peripheral circuit elements, the circuit realizing the means M4 and M5 according to a predetermined processing procedure.

The non-linear feedback controller for an internal combustion engine according to the present invention functions as follows. As exemplarily shown in FIG. 1, the control means M4 calculates a control quantity which is concerned with the control of the opening area of the intake passage of the internal combustion engine M1 from at least the intake pressure equivalent quantity and the rotational speed equivalent quantity which are detected by the operating condition detecting means M2 by the use of a parameter set on the basis of a dynamic physical model of the internal combustion engine M1. The compensating means M5 functions so as to output a manipulating quantity to the opening area controlling means M3 in such a manner that when the intake pressure equivalent quantity detected by the operating condition detecting means M2 is equal to or less than a critical pressure equivalent quantity, a value which is determined on the basis of the control quantity calculated by the control means M4 and a predetermined constant is defined as a manipulating quantity; whereas, when the intake pressure equivalent quantity exceeds the critical pressure equivalent quantity, a value obtained by compensating the control quantity in accordance with the intake pressure equivalent quantity is defined as a manipulating quantity.

More specifically, a control quantity is calculated using a single control law based on the dynamic physical model of the internal combustion engine M1, and when the intake pressure equivalent quantity is equal to or less than the critical pressure equivalent quantity, a value which is determined on the basis of the calculated control quantity and the predetermined constant is defined as a manipulating quantity; whereas, when the intake pressure equivalent quantity exceeds the critical pressure equivalent quantity, a value obtained by compensating the control quantity in accordance with the intake pressure equivalent quantity is defined as a manipulating quantity, to thereby control the opening area of the intake passage of the internal combustion engine M1.

Accordingly, in the case where it is difficult to apply a single control law based on the dynamic physical model of the internal combustion engine M1, for example, when the intake pressure equivalent quantity exceeds the critical pressure equivalent quantity, the non-linear feedback controller according to the present invention deduces a manipulating quantity by compensating the control quantity calculated on the basis of the control law in accordance with the intake pressure equivalent quantity, thereby matching the control law based on the dynamic physical model with the behavior of the internal combustion engine M1 that is the control object.

The constituent elements of the present invention function as detailed above to thereby solve the technical problem of the present invention.

Thus, according to the non-linear feedback controller for an internal combustion engine according to the present invention, when the intake pressure equivalent quantity exceeds the critical pressure equivalent quantity, for example, when the internal combustion engine runs under a relatively heavy load or is accelerated, a manipulating quantity is deduced by compensating the control quantity calculated on the basis of a single control law based on the dynamic physical model of the engine in accordance with the intake pressure equivalent quantity, thus controlling the opening area of the intake system of the engine. Therefore, in various kinds of operating conditions, the control law based on the dynamic physical model is effectively matched with the behavior of the internal combustion engine that is the control object. Accordingly, it is advantageously possible to control stably the rotational speed of the internal combustion engine or effect control so that the engine speed converges to a target rotational speed with a considerably high degree of accuracy.

Since control is effected using a single control law based on the dynamic physical model of the internal combustion engine, it is unnecessary to change the control law over a wide range of various kinds of operating conditions of the engine. Accordingly, it is possible to simplify the arrangement of the controller and improve the reliability.

Further, since a dynamic physical model is linearilized without deteriorating the dynamic characteristics of an internal combustion engine which has non-linear characteristics, the dynamic physical model is effectively conformable with the behavior of the internal combustion engine that is the control object over a wide range of operating conditions. Therefore, it is possible to effect feedback control of the rotational speed of the internal combustion engine while maintaining a high level of control response and follow-up characteristics at all times.

DETAILED DESCRIPTION OF THE PREFERRED EMBODIMENTS

Figure 1:
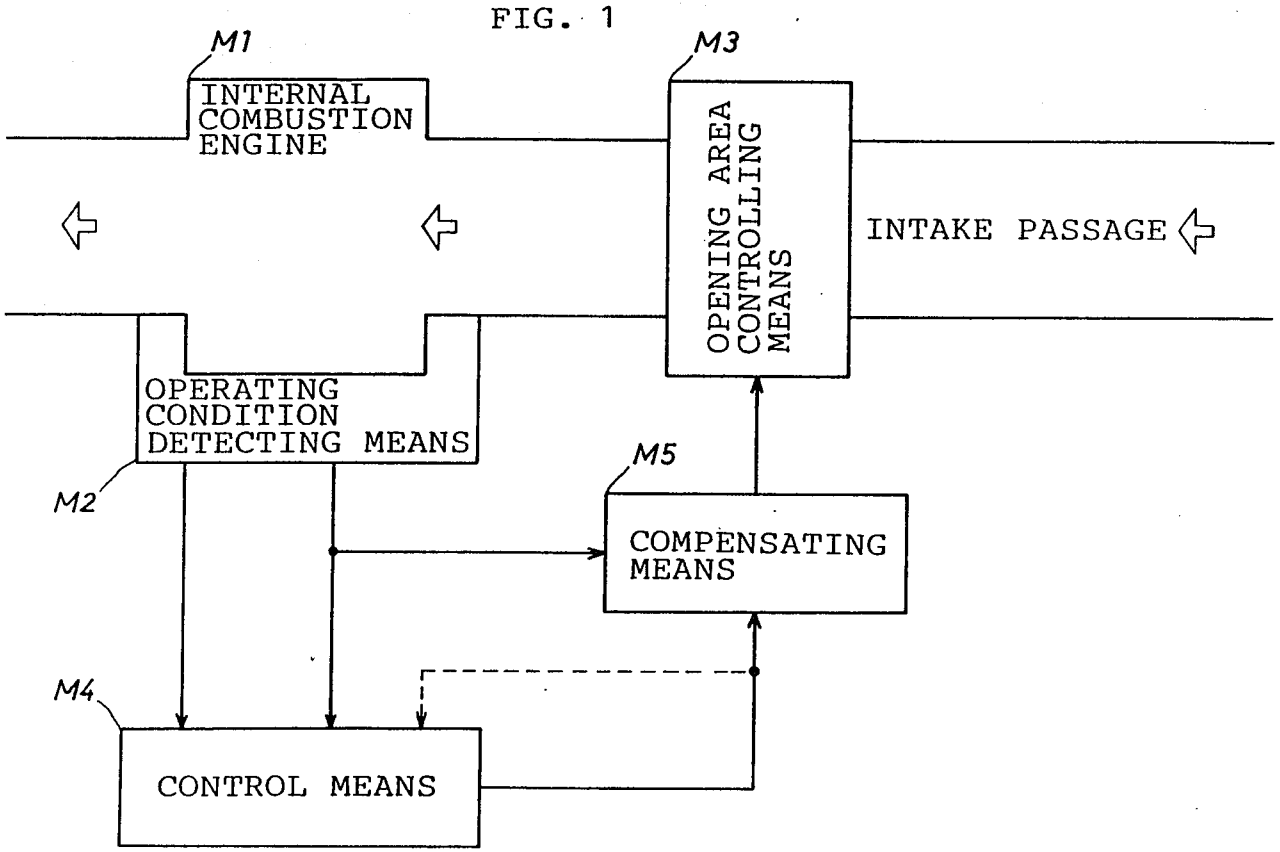
FIG. 1 shows the basic arrangement of the present invention, which conceptionally illustrates the contents of the present invention.
Figure 2:
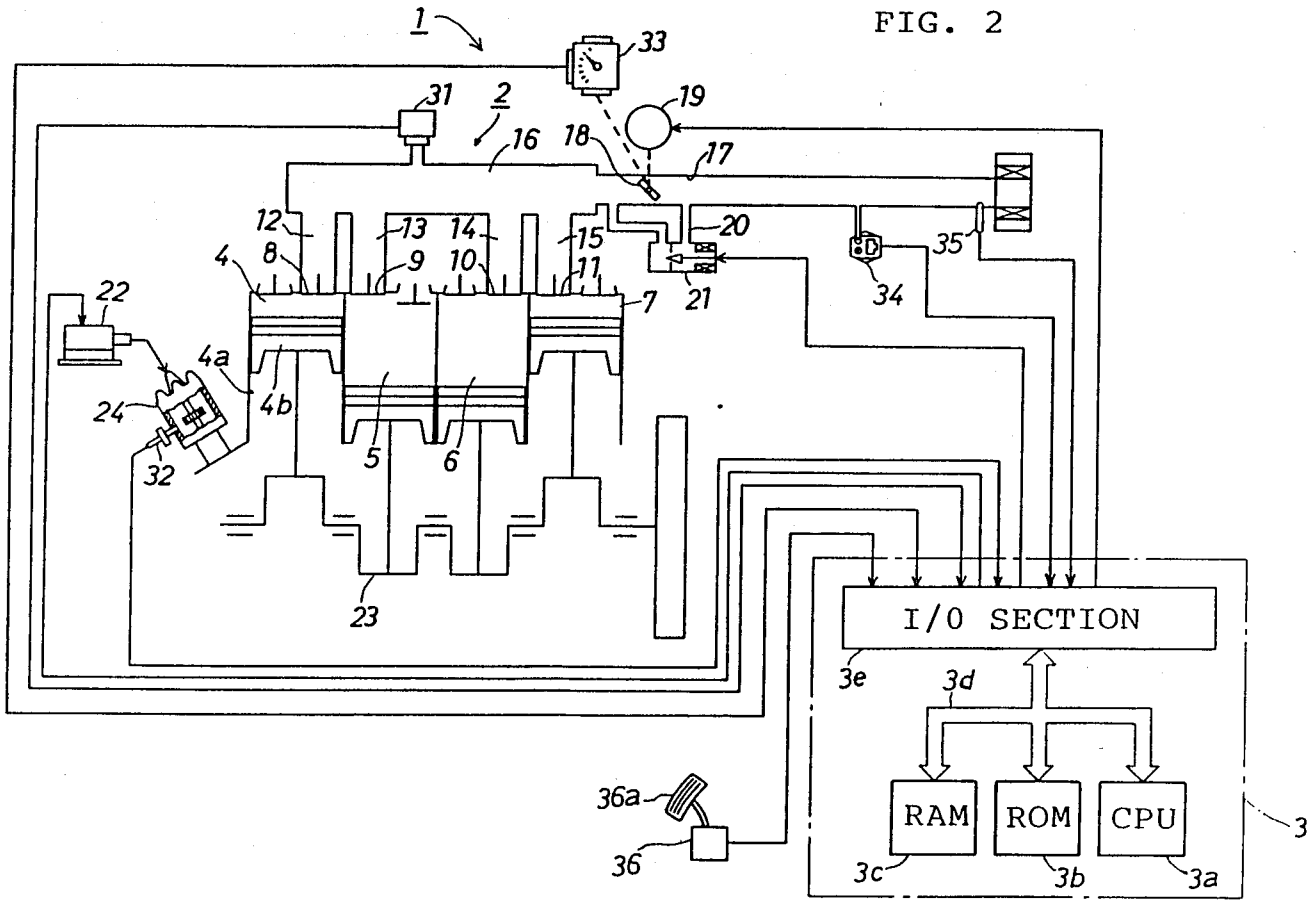
FIG. 2 is a system diagram showing the arrangement of one embodiment of the present invention.

Preferred embodiments of the present invention will be described hereinunder in detail with reference to the accompanying drawings. FIG. 2 is a system diagram showing the arrangement of one embodiment of the engine controller according to the present invention.

In this embodiment, the engine controller 1 comprises a four-cylinder engine 2 and an electronic control unit (hereinafter referred to as "ECU") 3 which controls the engine 2.

The engine 2 has a first combustion chamber 4 which is defined by a cylinder 4a and a piston 4b, and second to fourth combustion chambers 5, 6 and 7 which have the same arrangement as that of the first combustion chamber 4. The combustion chambers 4, 5, 6 and 7 communicate with intake manifolds 12, 13, 14 and 15 through intake valves 8, 9, 10 and 11, respectively. A surge tank 16 which absorbs pulsation of intake air is provided at the upstream side of the intake manifolds 12, 13, 14 and 15. A throttle valve 18 which controls the amount of intake air is disposed inside an intake pipe 17 which is provided at the upstream side of the surge tank 16. The throttle valve 18 is pivoted so as to change the degree of opening thereof by being supplied with driving force from a throttle actuator 19 defined by, for example, a DC motor or a stepping motor, which is activated in response to a control signal delivered from the abovedescribed ECU 3. The intake pipe 17 is provided with a throttle bypass 20, and an idling speed control valve (hereinafter referred to as simply "ISCV") 21 is interposed in the bypass 20. The opening degree of the ISCV 21 is changed in response to a duty ratio control signal from the ECU 3 and thereby controls the amount of intake air flowing through the bypass 20.

The engine 2 further has an ignitor 22 equipped with an ignition coil which generates a high voltage required for ignition, and a distributor 24 which distributes the high voltage generated in the ignitor 22 to the respective spark plugs (not shown) of the cylinders in response to the revolution of a crankshaft 23.

The engine controller 1 has the following sensors for detecting various parameters: an intake pressure sensor 31 which is disposed on the surge tank 16 to detect a level of intake pressure (i.e., pressure within the intake pipe); a rotational speed sensor 32 which outputs a rotational angle signal every 1/24 revolution of the camshaft of the distributor 24, i.e., every time the camshaft rotates an integral multiple of 15° (corresponding to a crank shaft rotation angle of 30°); a throttle position sensor 33 which detects a degree of opening of the throttle valve 18; an atmospheric pressure sensor 34 which is disposed in the intake pipe 17 at the upstream side of the throttle valve 18 to detect a level of atmospheric pressure; an intake-air temperature sensor 35 which is disposed near an air cleaner attached to the intake pipe 17 to measure a temperature of intake air; and an accelerator operated amount sensor 36 which detects an amount by which an accelerator pedal 36a is depressed.

Signals produced by the above-described sensors are input to the ECU 3, which controls the engine 2 on the basis of these input signals. The ECU 3 is arranged in the form of a logical arithmetic circuit which consists mainly of a CPU 3a, a ROM 3b and a RAM 3c, and is connected to an input/output section 3e through a common bus 3d to exchange input/output data with the outside. More specifically, the ECU 3 drives the throttle actuator 19 and the ISCV 21 on the basis of the results of detection which are input thereto from the intake pressure sensor 31, the rotational speed sensor 32, the throttle position sensor 33, the atmospheric pressure sensor 34, the intake-air temperature sensor 35 and the accelerator operated amount sensor 36 and in accordance with programs stored in the ROM 3b in advance, thereby effecting feedback control by which the rotational speed of the engine 2 is made to coincide with a target rotational speed.

Figure 3:
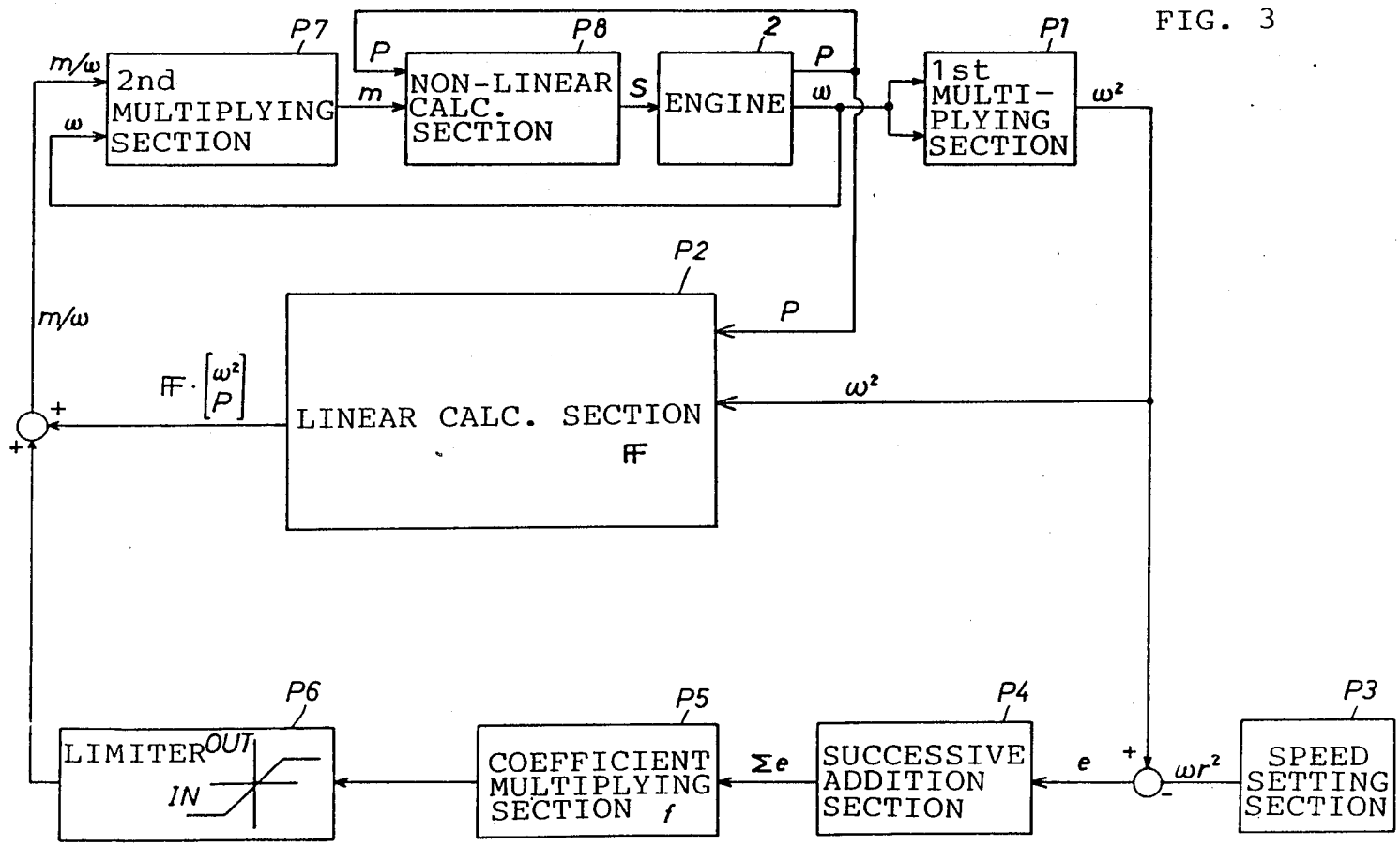
FIG. 3 is a block diagram showing the control system in the first embodiment.

A control system which is employed to effect the feedback control will next be explained with reference to a block diagram shown in FIG. 3. It should be noted here that FIG. 3 is a block diagram showing the control system but illustrating no hardware arrangement. The control system shown in FIG. 3 consists of discrete systems which are realized in actual practice by execution of a series of programs shown in the flowchart of FIG. 4.

As shown in FIG. 3, a first multiplying section P1 calculates a rotational speed square value $\omega^2$ from a rotational speed $\omega$ of the engine 2 that is the control object.

A linear calculation section P2 multiplies both the rotational speed square value $\omega^2$ and an intake pressure P by an element F concerning both the above-described values in an optimal feedback gain F′ (described later) to thereby calculate a first feedback quantity.

A target rotational speed setting section P sets a target rotational speed square value $\omega r^2$. In this embodiment, the target rotational speed $\omega r$ is a predetermined rotational speed in an idling state; in a normal running state, it is a command rotational speed given from an automatic transmission controller, or a rotational speed designated by a so-called automatic drive controller, or a result of detection effected by the accelerator operated amount sensor 36. The target rotational speed $\omega r$ thus determined is squared to set a target rotational speed square value $\omega r^2$.

A successive addition section P4 cumulates deviations e of the rotational speed square value $\omega^2$ from the target rotational speed square value $\omega r^2$ to thereby calculate a cumulative deviation $\Sigma e$.

A coefficient multiplying section P5 multiplies the cumulative deviation $\Sigma e$ by an element f concerning the cumulative deviation $\Sigma e$ in the optimal feedback gain F′ (described later) to calculate a second feedback quantity.

A limiter P6 sets upper-limit and lower-limit values for the cumulative deviation $\Sigma e$. When the cumulative deviation $\Sigma e$ is greater or smaller than the upper-limit or lower-limit value, the limiter P6 limits this cumulative value to the upper-limit or lower-limit value. The limiter P6 functions as follows. In the case where it is impossible to make the rotational speed square value $\omega^2$ coincident with the target rotational speed square value $\omega r^2$ due to a certain cause, the absolute value of the cumulative deviation $\Sigma e$ may become large without any restriction. In such a case, if no limiter is provided, abnormal control may be conducted when the disturbance causing the deviation disappears. Thus, the limiter P6 serves to prevent such abnormal control. The limiter P6 also functions to minimize overshoot and undershoot which are attributable to the cumulative deviation $\Sigma e$.

By adding together the first and second feedback quantities, a control quantity $m/\omega$ is calculated.

A second multiplying section P7 multiplies the control quantity $m/\omega$ by a rotational speed $\omega$ to thereby calculate an intake air quantity m for the engine 2.

A non-linear calculation section P8 calculates a manipulating quantity S by which the area of opening of the intake passage of the engine 2 is controlled in such a manner that, when the intake pressure P of the engine 2 is not higher than a critical pressure Pc, the non-linear calculation section P8 multiplies the intake air quantity m by a predetermined constant, whereas, when the intake pressure P exceeds the critical pressure Pc, the calculation section P8 multiplies the intake air quantity m by a value which is determined in accordance with the level of the intake pressure P. It should be noted that the effect of changes in the intake pressure P on the intake air quantity m will be described hereinafter. The above-described manipulating quantity S is equivalent to an effective crosssectional area of the intake passage of the engine 2. In other words, the manipulating quantity S is equivalent to the sum of the degrees of opening of the throttle valve 18 and the ISCV 21.

The above discussion describes the hardware arrangement of the engine controller 1 and the arrangement of the control system which is realized by execution of programs (described later). The following is a description of the effect of changes in the intake pressure P of the engine 2 on the intake air quantity m, the construction of a dynamic physical model of the engine 2, and the calculation of an optimal feedback gain F'.

First, the effect of the intake pressure P of the engine 2 on the intake air quantity m will be explained. Since the flow of intake air which passes through a throttle portion defined between the inner surface of the intake pipe 17 of the engine 2 and the throttle valve 18 is only slightly affected by viscosity, it is possible to regard changes in the intake air quantity as approximately homoentropic changes. Accordingly, the quantity of intake air passing through the throttle valve may be expressed by the following version of the St. Venant equation (3):

$$m=S\cdot[\{(2\cdot K)/(K-1)\}\cdot PO\cdot\rho 0\cdot\{(P/PO)^{2/K}-(P/PO)^{K+1/K}\}]^{\frac{1}{2}} \quad (3)$$

where m is the quantity of intake air passing through the throttle valve, S is the effective throttle valve opening area, K is the ratio of specific heats of intake air, PO is pressure at the upstream side of the throttle valve (e.g., atmospheric pressure), $\rho$ is the density of intake air, and P is intake pressure.

The equation (3) is modified by the use of the following equation (4) of state of a gas:

$$PO/\rho 0=R\cdot T \quad (4)$$

where R is the universal gas constant, and T is absolute temperature. Substituting equation (4) into equation (3) yields:

$$m=S\cdot\psi\cdot PO\cdot\{2/(R\cdot TO)\}^{\frac{1}{2}} \quad (5)$$

where TO is the temperature at the upstream side of the throttle valve, and the function $\psi$ is expressed as follows:

$$\psi=[\{K/(K-1)\}\cdot\{(P/PO)^{2/K}-(P/PO)^{(K+1)/K}\}]^{\frac{1}{2}} \quad (6)$$

According to the ve-described equation (5), the quantity m of intake air passing through the throttle valve is a function of the effective throttle valve opening area S, intake pressure P, throttle valve upstream-side pressure PO, and throttle valve upstream-side temperature TO. The intake air quantity m reaches its maximum when the following equation (7) holds with respect to the pressure ratio P/PO. At this time, the function $\psi$ is expressed by the equation (8), and the maximum value of the intake air quantity m is expressed by the equation (9):

$$P/PO = \{2/(K+1)\}^{K/(K-1)} \quad (7)$$

$$\psi = \{2/(K+1)\}^{1/(K-1)}\cdot\{K/(K+1)\}^{1/2} \quad (8)$$

$$m_{max} = S\cdot\{2/(K+1)\}^{1/(K-1)}\cdot\{K/(K+1)\}^{1/2}\cdot PO\cdot(2/R\cdot TO)^{1/2} \quad (9)$$

A pressure P which satisfies the conditions of the above-described equation (7) is referred to as the critical pressure, and the flow velocity of intake air which passes through te throttle valve when the internal pressure P is not higher than the critical pressure equals sonic velocity. Moreover, within the range where the following equation (10) is applicable, the intake air quantity m is held at the maximum value $m_{max}$ expressed by the above-described equation (9):

$$P/PO \leqq \{2/(K+1)\}^{K/(K-1)} \quad (10)$$

More specifically, even if the intake pressure P is sufficiently small to exceed sonic velocity, a pressure which is equivalent to sonic velocity appears alone at the opening of the throttle valve at all times [for example, in the case of diatomic gases such as air, said pressure is about 0.53 times a static pressure {e.g., the pressure PO (atmospheric pressure) at the upstream side of the throttle valve}]. Accordingly, the flow of intake air becomes so-called critical flow, and the intake air quantity m is completely independent of the intake pressure P.

On the other hand, within the range where the following equation (11) is applicable, the flow of intake air is affected by the intake pressure P. Therefore, the intake air quantity m decreases from the maximum value $m_{max}$ expressed by the equation (9) as the intake pressure P rises as shown by the above-described equations (5) and (6):

$$P/PO > \{2/(K+1)\}^{K/(K-1)} \quad (11)$$

Thus, when the intake pressure P is not higher than the critical pressure, that is, when the engine is running under a relatively light load, the quantity m of intake air passing through the throttle valve is proportional to the effective throttle valve opening area S. However, when the intake pressure P exceeds the critical pressure, that is, when the engine is running under a relatively heavy load, the intake air quantity m is affected to a substantial extent by changes in the intake pressure P in addition to the effective throttle valve opening area S and is also somewhat affected by changes in the throttle valve upstream-side pressure PO and the throttle valve upstream-side temperature TO.

Accordingly, in this embodiment our attention is particularly focused on the intake pressure P, and when the intake pressure P is not higher than the critical pressure, the intake air quantity m is calculated on the basis of the above-described equation (9); whereas, when the intake pressure P exceeds the critical pressure, the intake air quantity m is calculated on the basis of the equations (5) and (6), with the intake pressure P used as a parameter, and an effective throttle valve opening area S is obtained from the intake air quantity m thus calculated.

It should be noted that the effective throttle valve opening area S may be obtained from the intake air quantity m and the intake pressure P by direct calculation using the equation (9) or the equations (5) and (6). It is also possible to obtain the effective throttle valve opening area S by calculating a corresponding value by means of interpolation using an approximate expression of each of the above-described equations, or a table or map prepared by calculating values of the equations in advance.

Next, a dynamic physical model of the engine 2 is constructed as follows. The equation of motion of the engine 2 which is in an operative state may be expressed as follows:

$$d\omega/dt = (1/I)\cdot\left[\sum_{i=1}^{n}(Pci - Pa)\cdot(dVci/d\theta) - Tf - Tl\right] \tag{12}$$

where $\omega$ is the rotational speed, t is time, I is the inertia moment of the rotational portion of the engine, n is the number of cylinders, Pci is the pressure within the i-th cylinder, Pa is the atmospheric pressure, $\sigma$ is the crank angle, Vci is the volume of i-th cylinder, Tf is the mechanical loss of torque, and T$\lambda$ is the actual load torque.

On the other hand, the mass conservation law concerning the quantity of intake air in that cylinder of the engine 2 which is in the intake stroke may be expressed as follows:

$$DP/dt = (C^2/V)\cdot\left[m - \sum_{i=1}^{n}\{(Kc/(Kc-1))\cdot P\cdot(dVci/dt) - qm\}/\{(Ki/(Ki-1))\cdot Ri\cdot Ri\}^*\right] \tag{13}$$

It should be noted that the term marked with * is 0 in the strokes other than the intake stroke.

In the above equation (13), P is the intake pressure (pressure in the intake pipe), C is the velocity of sound, m is the quantity of intake air sucked into the combustion chamber through the throttle valve, Kc is the ratio of specific heats of fuel-air mixture, qm is the heat transfer quantity of the wall surface of the cylinder, Ki is the ratio of specific heats of intake air, Ri is the gas constant of intake air, Ti is the temperature of intake air, and V is the volume of intake air.

Since in the above-described equation (12) the torque is substantially proportional to the intake pressure P, the following approximate expression may hold:

$$(1/I)\cdot\left[\sum_{i=1}^{n}(Pci - Pa)\cdot(dVci/d\theta)\right] = \alpha tl\cdot P \tag{14}$$

Since in the above-described equation (13) the quantity m of intake air sucked into the cylinder is proportional to the product of the rotational speed $\omega$ of the engine 2 and the intake pressure P, the following approximate expression may be valid:

$$-(C^2/V)\cdot\left[\sum_{i=1}^{n}\{(Kc/(Kc-1))\cdot P\cdot(dVci/dt) - qm\}/\{(Ki/(Ki-1))\cdot Ri\cdot Ti\}^*\right] = \alpha p2\cdot P\cdot\omega \tag{15}$$

It should be noted that the term marked with is 0 in the strokes other than the intake stroke.

On the basis of the equations (14) and (15), the above-described equations (12) and (13) may be approximated as follows:

$$d\omega/dt = \alpha tl\cdot P - Tf - T\lambda \tag{16}$$

$$dP/dt = m - \alpha p2\cdot P\cdot\omega \tag{17}$$

Here, in order to convert the differential d/dt with respect to time in each of the equations (16) and (17) into a differential d/d$\sigma$ with respect to the crank angle $\sigma$, the relationship therebetween is obtained. In consequence, the rotational speed $\omega$ of the engine 2 may be expressed using the crank angle $\sigma$ as follows:

$$\omega = d\theta/dt \tag{18}$$

Accordingly, the following equations may be deduced:

$$\begin{aligned} d\omega/dt &= (d\omega/d\theta)\cdot(d\theta/dt) \\ &= \omega\cdot(d\omega/d\theta) \end{aligned} \tag{19}$$

$$\begin{aligned} dP/dt &= (dP/d\theta)\cdot(d\theta/dt) \\ &= \omega\cdot(dP/d\theta) \end{aligned} \tag{20}$$

Employment of the relationship between the equations (19) and (20) enables the following equations (21) and (22) to be obtained from the above-described equations (16) and (17):

$$\omega\cdot(d\omega/d\sigma) = \alpha tl\cdot P - Tf - T\lambda \tag{21}$$

$$\omega\cdot(dP/d\sigma) = m - \alpha p2\cdot P\cdot\omega \tag{22}$$

The equations (21) and (22) may be modified to obtain the following equations (23) and (24):

$$(\tfrac{1}{2})\cdot(d\omega^2/d\sigma) = \alpha tl\cdot P - Tf - T\lambda \tag{23}$$

$$dP/d\sigma = m/\omega - \alpha p2\cdot P \tag{24}$$

The equations (23) and (24) are then made discrete, and on the assumption that the mechanical loss of torque Tf is proportional to the rotational speed $\omega$, the mechanical loss of torque Tf is expressed as the following equation (25) using a constant term $\beta$, and the actual load torque T$\lambda$ is expressed as the following equation (26) using the constant term $\beta$ and the load torque T'. Then, each constant term is modified to obtain the following equations (27) and (28) which are fundamental equations for identification in the case of sampling every predetermined crank angle.

$$Tf = \alpha' \cdot \omega^2 + \beta \tag{25}$$

$$T' = Tl + \beta/\alpha^3 \tag{26}$$

$$\omega^2(k+1) = \alpha 1 \cdot \omega^2(k) + \alpha 2 \cdot P(k) + \alpha 3 \cdot T'(k) \tag{27}$$

$$P(k) = \alpha 4 \cdot P(k) + \alpha 5 \cdot \{m(k)/\omega(k)\} \tag{28}$$

Then, the constant terms in the equations (27) and (28) are identified by the method of least squares to obtains the following state equation (29) and output equation (30):

$$\begin{bmatrix} \omega^2(k+1) \\ P(k+1) \end{bmatrix} = \begin{bmatrix} \alpha 1 & \alpha 2 \\ 0 & \alpha 4 \end{bmatrix} \cdot \begin{bmatrix} \omega^2(k) \\ P(k) \end{bmatrix} + \begin{bmatrix} 0 \\ \alpha 5 \end{bmatrix} \cdot \{m(k)/\omega(k)\} + \begin{bmatrix} \alpha 3 \\ 0 \end{bmatrix} \cdot T'(k) \tag{29}$$

$$\begin{bmatrix} \omega^2(k) \\ P(k) \end{bmatrix} = \begin{bmatrix} 1 & 0 \\ 0 & 1 \end{bmatrix} \cdot \begin{bmatrix} \omega^2(k) \\ P(k) \end{bmatrix} \tag{30}$$

Thus, a dynamic physical model in accordance with this embodiment is obtained as being expressed by the abovedescribed equations (29) and (30). This dynamic physical model is obtained by effectively linearizing the engine 2 having non-linear characteristics.

The way in which the optimal feedback gain F' is obtained will next be explained. Since the technique of obtaining the optimal feedback gain F' is detailed, for example, in J. E. Potter, "Matrix Quadratic Solutions", J. SIAM Appl. Math. Vol. 14, No. 3 (1966) and in Y. Bar-Ness & A. Halbersberg, "Solution of Discrete Regulator Problem Using Eigen Vector Methods", Int. J. Control (1980), detailed explanation thereof is omitted herein and the results alone will be shown in the following.

First, assuming that the target rotational speed square value $\omega r^2$ changes in stepwise fashion, the deviation e(k) of the rotational speed square value $\omega(k)^2$ from the target rotational speed square value $\omega r^2$ is introduced and the system expressed by the above-described equation (29) is enlarged to a servo system. It should be noted that the Smith-Davison design method is used in this embodiment.

Here, the deviation e(k) is expressed as follows:

$$e(k) = \omega(k)^2 - \omega r^2 \tag{31}$$

A difference $\Delta e(k)$ relative to the deviation e(k) is obtained as follows:

$$\Delta e(k) = \Delta\omega(k)^2 - \Delta\omega r^2 = \Delta\omega(k)^2 \tag{32}$$

Therefore, the deviation e(k) may be expressed as follows:

$$e(k) = e(k-1) + \Delta\omega(k)^2 \tag{33}$$

From the above-described equations (29) and (33), the system which has been enlarged to a servo system is expressed in regard to the difference value as shown by the following state equation (34). It should be noted here that $\Delta T'(k) = 0$ on the assumption that the load torque T' changes in a stepwise manner.

$$\begin{bmatrix} \Delta\omega(k+1)^2 \\ \Delta P(k+1) \\ e(k) \end{bmatrix} = \begin{bmatrix} \alpha 1 & \alpha 2 & 0 \\ 0 & \alpha 4 & 0 \\ 1 & 0 & 1 \end{bmatrix} \cdot \begin{bmatrix} \Delta\omega(k)^2 \\ \Delta P(k) \\ e(k-1) \end{bmatrix} + \begin{bmatrix} 0 \\ \alpha 5 \\ 0 \end{bmatrix} \cdot \Delta\{m(k)/\omega(k)\} \tag{34}$$

The above equation (34) may be regarded as follows:

$$\delta X(k+1) = Pa \cdot \delta X(k) + Ga \cdot \delta u(k) \tag{35}$$

In consequence, the discrete quadratic criterion function may be expressed as follows:

$$J = \sum_{k=0}^{\infty} [\delta X^T(k) \cdot Q \cdot \delta X(k) + \delta u^T(k) \cdot R \cdot \delta u(k)] \tag{36}$$

Here, an input $\delta u(k)$ which minimizes the discrete quadratic criterion function J with weight parameter matrices Q and R being selected is given as follows:

$$\delta u(k) = F' \cdot \delta X(k) \tag{37}$$

Accordingly, the optimal feedback gain F' is determined as follows:

$$F' = -(R + Ga^T \cdot M \cdot Ga)^{-1} \cdot Ga^T \cdot M \cdot Pa \tag{38}$$

where M is a definite symmetric matrix which satisfies the following discrete Riccati equation:

$$M = Pa^T \cdot M \cdot Pa + Q - (Pa^T \cdot M \cdot Ga) \cdot (R + Ga^T \cdot M \cdot Ga)^{-1} \cdot (Ga^T \cdot M \cdot Pa) \tag{39}$$

Thus, the deviation $\Delta\{m(k)/\omega(k)\}$ of the control quantity is obtained as follows:

$$\Delta\{m(k)/\omega(k)\} = F \cdot \begin{bmatrix} \Delta\omega(k)^2 \\ \Delta P(k) \end{bmatrix} + f \cdot e(k+1) \tag{40}$$

where F'=[F f], more particularly, F=[F11 F12].

When the above equation (40) is integrated, the control quantity $m(k)/\omega(k)$ is determined as follows:

$$m(k)/\omega(k) = F \cdot \begin{bmatrix} \omega(k)^2 \\ P(k) \end{bmatrix} + f \cdot \sum_{j=0}^{k-i} e(j) \tag{41}$$

The above discussion describes the effect of changes in the intake pressure P of the engine 2 on the intake air quantity m and the methods of constructing a dynamic physical model of the engine 2 and of calculating the optimal feedback gain F'. It should be noted that the value for the function $\psi$ which is concerned with the quantity m of intake air passing through the throttle valve, the optimal feedback gain F', etc. are calculated in advance, and the previously obtained results alone are employed inside the ECU 3 to effect actual control.

Engine control processing which is executed by the ECU 3 will next be explained with reference to the flowchart shown in FIG. 4. It should be noted that in the following description a quantity which is handled in a present processing is expressed using a suffix (k). This engine control processing is commenced when the ECU 3 is started.

First, in Step 100 are executed initializations such as clearing of registers inside the CPU 3*a*, setting of an initial value for the second feedback quantity i.e., and setting of an upper-limit value iemax and a lower-limit value iemin for the second feedback quantity ie. In the subsequent Step 110, a target rotational speed $\omega r$ is read. Then, the process proceeds to Step 120, where a target rotational speed square value $\omega r^2$ is calculated. The processings carried out in Steps 110 and 120 function in combination as the target rotational speed setting section P3 shown in FIG. 3. In the subsequent Step 130 are read a rotational speed $\omega(k)$, an intake pressure P(k), a throttle valve upstream-side pressure {atmospheric pressure} PO(k) and an intake air temperature (throttle valve upstream-side temperature) TO(k). Then, the process proceeds to Step 140, where a rotational speed square value $\omega(k)^2$ is calculated from the rotational speed $\omega(k)$ read in Step 130. The procedure carried out in Step 140 functions as the first multiplying section P1 shown in FIG. 3.

In the subsequent Step 150, the rotational speed square value $\omega(k)^2$ calculated in Step 140 and the intake pressure P(k) read in Step 130 are multiplied by the element F in the optimal feedback gain F' to obtain a first feedback quantity, and the second feedback quantity ie is added to the first feedback quantity to obtain a control quantity $m(k)/\omega(k)$ as follows:

$$m(k)/\omega(k)=F11\cdot\omega(k)^2+F12\cdot P(k)+ie \quad (42)$$

The procedure carried out in Step 150 functions as the linear calculation section P2 shown in FIG. 3. Then, the process proceeds to Step 160, where an intake air quantity m(k) is calculated from the control quantity $m(k)/\omega(k)$ calculated in Step 150 as follows:

$$m(k)=\{m(k)/\omega(k)\}\cdot\omega(k) \quad (43)$$

The procedure carried out in Step 160 functions as the second multiplying section P7 shown in FIG. 3.

In the subsequent Step 170, a pressure ratio C is calculated from the intake pressure P(k) and the throttle valve upstream-side pressure {atmospheric pressure} PO(k) read in Step 130, as shown in the following equation (44). It should be noted that a value obtained by actual measurement may be employed as the throttle valve upstream-side pressure (atmospheric pressure) PO(k), or the pressure PO(k) may be calculated, for example, as a constant having a value 101 [KPa] since the pressure PO(k) is unlikely to change to a substantial extent in a normal running state.

$$C=P(k)/PO(k) \quad (44)$$

Then, the process proceeds to Step 180, where it is judged whether or not the pressure ratio C calculated in accordance with the equation (44) is equal to or less than a critical pressure ratio, i.e., 0.53. If YES, the process proceeds to Steps 190; whereas, if NO is the answer, the process proceeds to Step 200.

In Step 190 which is executed when the pressure ratio C is equal to or less than the critical pressure ratio 0.53, that is, when the flow velocity of intake air passing through the throttle valve is equal to the sound velocity, the value of the function $\psi$ is set at 0.484 which is determined on the basis of the aforementioned equation (8), and thereafter the process proceeds to Step 210. It should be noted that in this embodiment the specific heat ratio K was calculated as being 1.4.

In Step 200 which is executed when the pressure ratio C exceeds the critical pressure ratio 0.53, that is, when the flow velocity of intake air passing through the throttle valve is lowered by the effect of the intake pressure P, the value of the function $\psi$ is calculated on the basis of the aforementioned equation (6) in a manner shown in the following equation (45), and thereafter the process proceeds to Step 210.

$$\psi=\{3.5\times(C^{1.4}-C^{1.7})\}^{\frac{1}{2}} \quad (45)$$

In the subsequent Step 210, an effective throttle valve opening area S which is manipulating quantity is calculated as shown in the following equation (46) on the basis of the aforementioned equation (5) using the function $\psi$ obtained in either Step 190 or 200.

$$S(k)=0.21\times10^{-2}\times m(k)/\psi \quad (46)$$

Here, the gas constant R is set at 287.1 [J/Kg·°K], and a value obtained by actual measurement may be employed as the intake air temperature (throttle valve upstream-side temperature) TO(k). Since the intake air temperature TO(k) changes only relatively gently, it may also be calculated, for example, as being a constant having a value of 303 [°K].

The procedures carried out in Steps 180 to 210 function in combination as the non-linear calculation section P8 shown in FIG. 3.

Then, the process proceeds to Step 220, where a deviation e(k) of the rotational speed square value $\omega(k)^2$ obtained in Step 140 from the target rotational speed square value $\omega r^2$ obtained in Step 120 is calculated as follows:

$$e(k)=\omega(k)^2-\omega r^2 \quad (47)$$

In the subsequent Step 230, a product of the deviation calculated in Step 220 and the element f concerning the deviation in the optimal feedback gain F' is cumulated to calculate a second feedback quantity ie as follows:

$$ie=ie+f\cdot e(k) \quad (48)$$

The processing carried out in Step 230 functions as both the successive addition section P4 and coefficient multiplying section P5 which are shown in FIG. 3.

Then the process proceeds to Step 240, where it is judged whether or not the second feedback quantity ie calculated in Step 230 is equal to or less than the upper-limit value iemax. If YES, the process proceeds to Step 250; whereas, if NO is the answer, the process proceeds to Step 260. In Step 260, which is executed when the second feedback quantity ie is judged to be in excess of the upper-limit value iemax, the second feedback quantity ie is set to the upper-limit value iemax, and the process proceeds to Step 280.

In Step 250, which is executed when it is judged in Step 240 that the second feedback quantity ie is equal to or less than the upper-limit value iemax, a judgment is made as to whether or not the second feedback quantity ie is equal to or more than the lower-limit value iemin. If YES, the process proceeds to Step 280; whereas, if NO is the answer, the process proceeds to Step 270. In Step 270 which is executed when the second feedback quantity ie is judged to be less than the lower-limit value iemin, the second feedback quantity ie is set to the lower-limit value iemin, and the process proceeds to Step 280.

The procedures carried out in Steps 240 to 270 function in combination as the limiter P6 shown in FIG. 3.

In the subsequent Step 280, a driving signal which is equivalent to the effective throttle valve opening area S(k) calculated in Step 210 as a manipulating quantity is output to either the throttle actuator 19 or the ISCV 21 through the input/output section 3*e*. Then, the process proceeds to Step 290, where a value 1 is added to the suffix K which denotes the number of cycles of sampling, calculation and control that have been done, thereby renewing the suffix K, and the process then returns to the Step 110. Thereafter, the abovedescribed Steps 110 to 290 are executed repeatedly.

According to this embodiment arranged as described above, in the case where the intake pressure P of the engine 2 exceeds the critical pressure Pc, for example, when the throttle valve opening is relatively large at the time of heavy-load running, starting, acceleration or the like, the intake air quantity m which is deduced from the control quantity $m/\omega$ calculated using the optimal feedback gain F' obtained on the basis of the dynamic physical model using the rotational speed square value $\omega^2$ and intake pressure P of the engine 2 as state variables is compensated in accordance with the level of the intake pressure P to thereby determine an effective throttle valve opening area S which is a manipulating quantity. Therefore, it is possible to considerably improve response and follow-up characteristics in the rotational speed control of the engine 2 and thus increase the degree of accuracy in the control by a large margin.

Since this embodiment is arranged such that the intake air quantity m is first deduced from a control quantity $m/\omega$ which is calculated on the basis of a single control law according to one and only dynamic physical model of the engine 2 and the effective throttle valve opening area S is then calculated from both the intake air quantity m and the intake pressure P, it is possible with a single control law to cope with the operating conditions of the engine 2 over a wide range. This avoids the prior complicated and troublesome control procedures in which control laws are changed from one to another in accordance with the operating conditions. Thus, it is possible to simplify the arrangement of the controller and improve the reliability.

For example, during idling, the idling speed is maintained at a target idling speed by optimal opening control effected by the ISCV 21, so that the stability in the idling speed control is enhanced. On the other hand, during a transient state at the time, for example, of starting or accelerating the vehicle, the throttle valve opening is controlled so as to be optimal by the operation of the throttle actuator 19. There is therefore no occurrence of so-called acceleration surging which makes the driver feel uncomfortable. Thus, the drivability of the vehicle is improved, and the driver can enjoy comfortable driving.

The above-described advantageous effects are produced by virtue of the arrangement in which the throttle valve opening area S is determined by making compensation for the intake air quantity m in accordance with the intake pressure P on the basis of the result of the judgment as to whether or not the intake pressure is equal to or less than the critical pressure Pc, thereby effectively matching the behavior of the non-linear engine 2 in a transient state with the dynamic physical model of the engine 2.

Further, since in this embodiment sampling is carried out every predetermined crank angle, it is possible to effect control which conforms to each phenomenon occurring synchronously with the crank angle of the engine 2. This produces a particularly marked effect when a control system having the same arrangement as that of this embodiment is applied, for example, to fuel injection quantity control, fuel injection timing control or ignition timing control of the engine 2.

It should be noted that, although in this embodiment the function $\psi$ is obtained in Step 200 of the engine control processing by subjecting the pressure ratio C to exponential calculation, the arrangement may be such that the function $\psi$ is obtained by performing approximate calculation with respect to the exponential calculation or it is obtained by, for example, interpolation using a map or the like containing results of exponential calculation of a predetermined number of pressure ratios C obtained in advance, whereby the calculation speed can be increased.

In this embodiment, a dynamic physical model which uses the rotational speed square value $\omega^2$ and intake pressure P of the engine 2 as state variables is constructed and a first feedback quantity is obtained in the linear calculation section P2 by performing linear calculation using the state variables and the optimal feedback gain F'. However, the arrangement may be such that an estimated load torque value $\hat{T}'$ for the engine 2 is calculated by using an observer, a dynamic physical model which uses the estimated load torque value $\hat{T}'$, rotational speed square value $\omega^2$ and intake pressure P as state variables is constructed, and a first feedback quantity is obtained by linear calculation using these state variables and an optimal feedback gain Fa' obtained by enlarging the dynamic physical model into a servo system. More specifically, as shown in FIG. 5, an observer P10 is employed which calculates the estimated load *torque value* $\hat{T}'^{40}$ from the control quantity $m/\omega$, rotational speed square value $\omega^2$ and intake pressure P.

Figure 5:
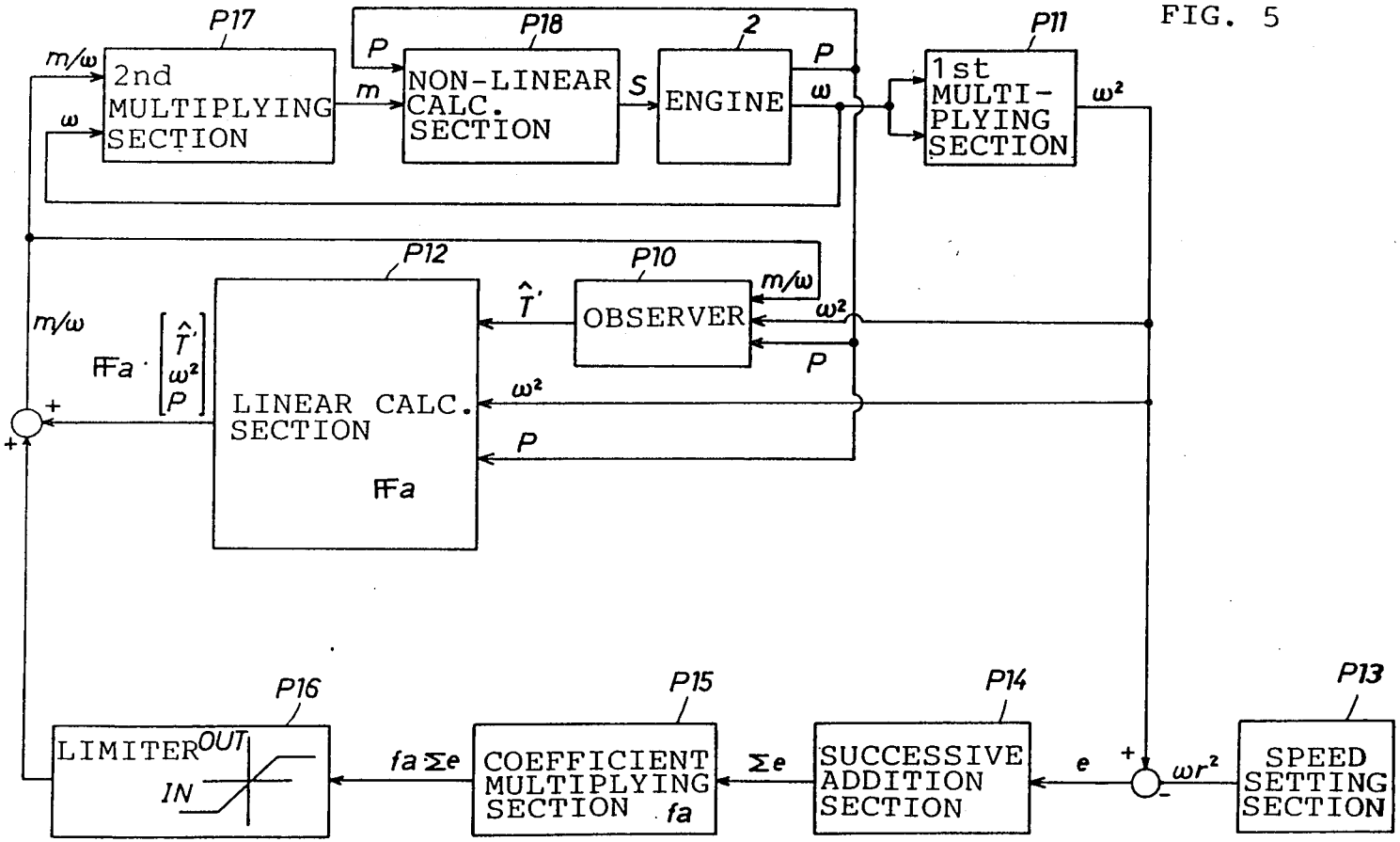
FIG. 5 is a block diagram showing a control system in accordance with another embodiment of the present invention.

Although the control system shown in FIG. 5 is a servo system obtained by enlarging the dynamic physical model, it will be explained hereinafter as a control system which is directly concerned with the design of the observer 10, that is, as a control system which is in the form of a mere regulator before the enlargement into a servo system. The dynamic physical model in this case may be expressed by the following state equation (49) and output equation (50):

$$\begin{bmatrix} T'(k+1) \\ \omega(k+1)^2 \\ P(k+1) \end{bmatrix} = \tag{49}$$

-continued $$\begin{bmatrix} 1 & 0 & 0 \\ \alpha 3 & \alpha 1 & \alpha 2 \\ 0 & 0 & \alpha 4 \end{bmatrix} \cdot \begin{bmatrix} T'(k) \\ \omega(k)^2 \\ P(k) \end{bmatrix} + \begin{bmatrix} 0 \\ 0 \\ \alpha 5 \end{bmatrix} \cdot \{m(k)/\omega(k)\}$$

$$\begin{bmatrix} \omega(k)^2 \\ P(k) \end{bmatrix} = [0\ 1\ 1] \cdot \begin{bmatrix} T'(k) \\ \omega(k)^2 \\ P(k) \end{bmatrix} \quad (50)$$

The observer may be designed according to a known method such as the Gopinath design method (cf. B. Gopinath, "On the Control of Linear Multiple Input-Output Systems", The Bell Technical Journal (1971)). Although various observer designing methods are known and detailed, for example, in Katsuhisa Furuta et al. "Basic System Theory" (1978), Coronasha, Ltd., the observer is designed herein as a minimal order observer according to the Gopinath design method.

The above-described equations (49) and (59) are simplified as follows:

$$Xb(k+1) = Pb \cdot Xb(k) + Gb \cdot u(k) \quad (51)$$

$$yb(k) = T \cdot Xb(k) \quad (52)$$

Thus, the minimal order observer of the dynamic physical model which is expressed by the above equations (51) and (52) is determined as follows:

$$Z(k) = \hat{A} \cdot Z(k-1) + \hat{B} \cdot yb(k-1) + \hat{J} \cdot u(k-1) \quad (53)$$

$$\hat{x}b(k) = \hat{C} \cdot Z(k) + \hat{D} \cdot yb(k) \quad (54)$$

where $$U \cdot Pb - \hat{A} \cdot U = \hat{B} \cdot T$$

$$\hat{J} = U \cdot Gb$$

$$[\hat{C}\ \hat{D}] \cdot [U\ T]^T = I$$

and U is determined so that all the absolute values of eigen-values of $\hat{A}$ are less than 1.

On the basis of the above equations (53) and (54), it is possible to obtain an estimated load torque value T'(k) and an estimated actual load torque value Tλ(k).

Figure 4A:
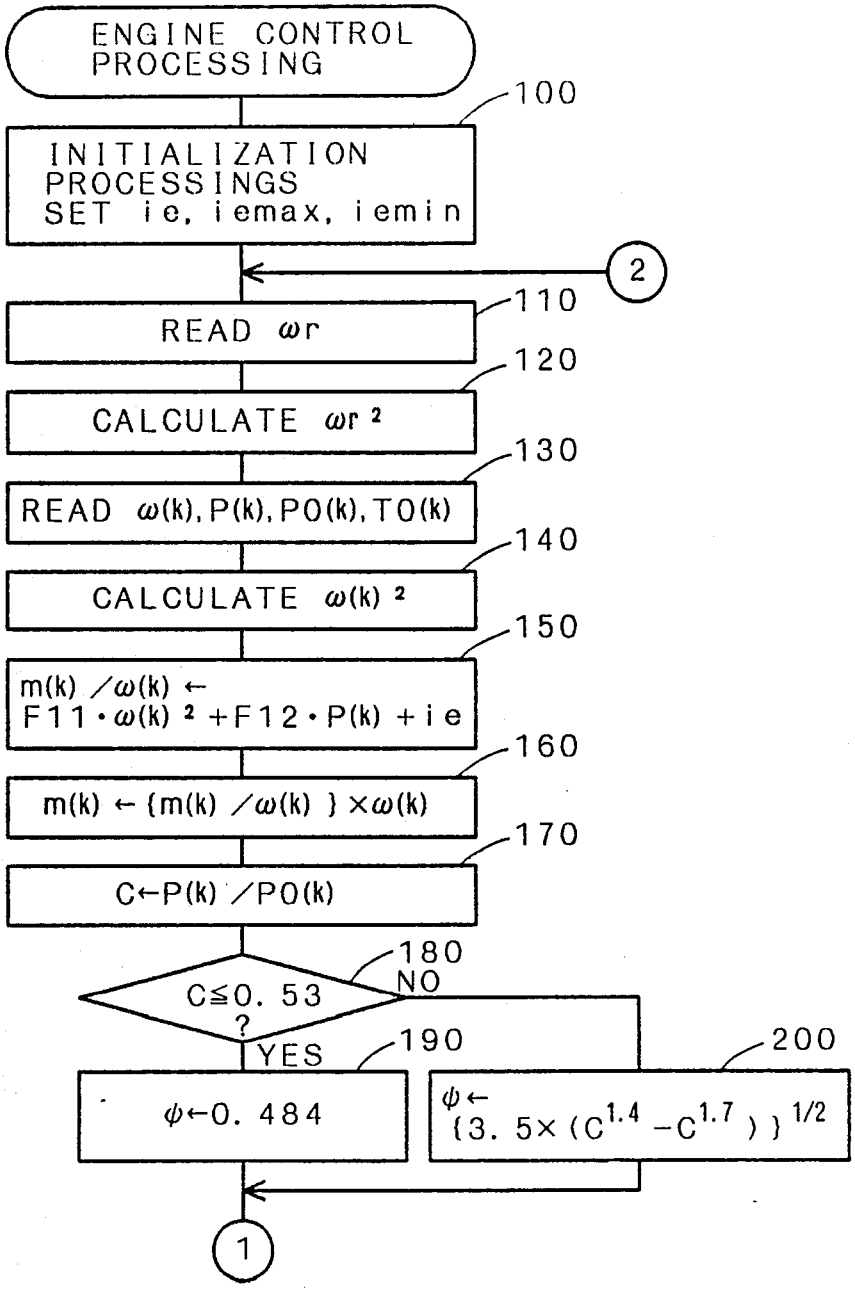
FIGS. 4A and 4B are flowcharts integrally showing the control effected by the first embodiment.
Figure 4B:
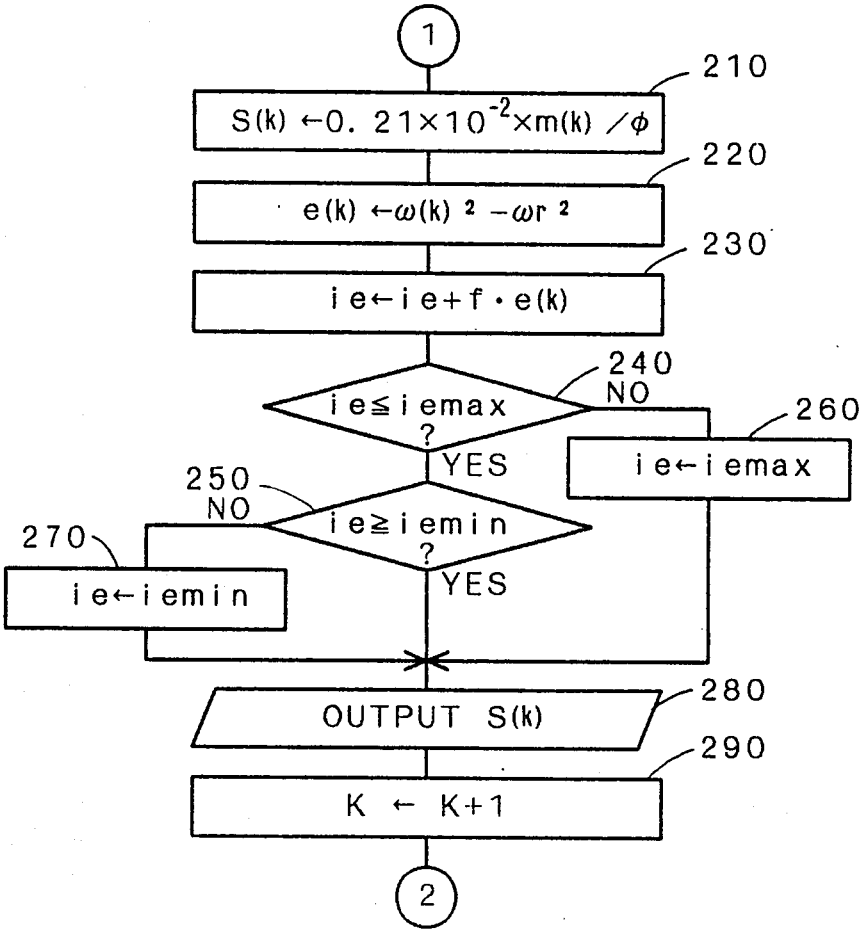
Figure 6:
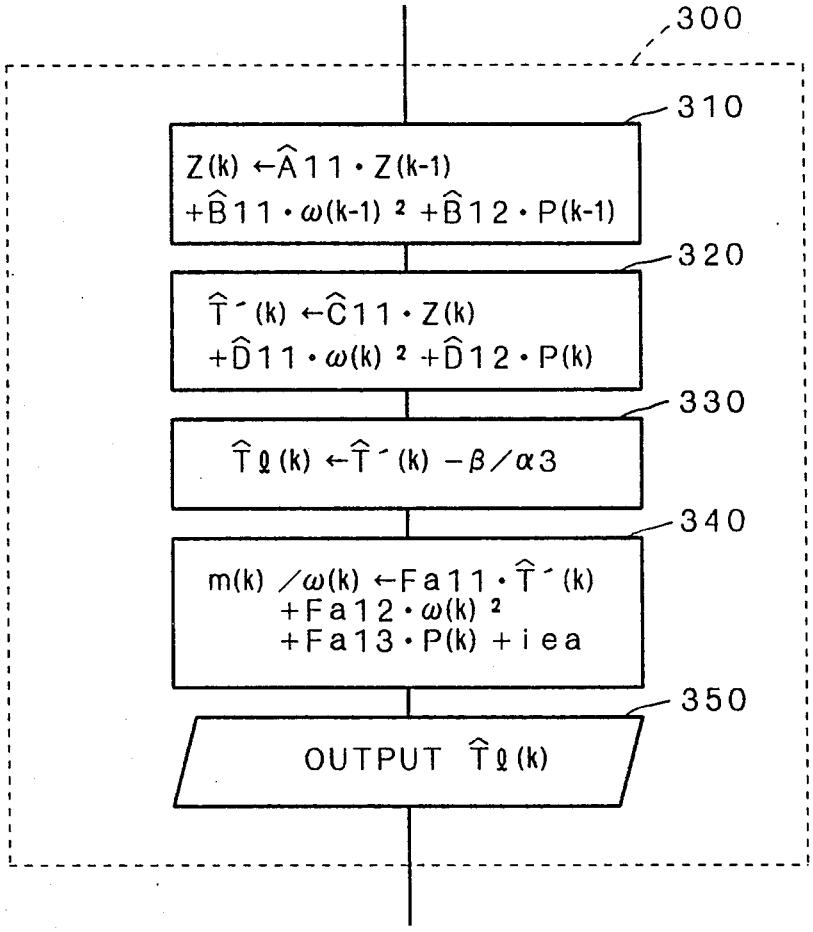
FIG. 6 is a flowchart showing the characteristic part of the control which is effected by the second embodiment.

The control system that uses the observer P10 as described above can be realized, for example, by executing Steps 310 to 350 shown in FIG. 6 in place of Step 150 in the engine control processing shown in FIG. 4 in accordance with the already-described embodiment. More specifically, as shown in FIG. 6, an estimated load torque value $\hat{T}'(k)$ is calculated in Steps 310 and 320. First, a variable Z(k) in the observer is calculated in Step 310 as follows:

$$Z(k) = \hat{A}11 \cdot Z(k-1) + \hat{B}11 \cdot \omega(k-1)^2 + \hat{B}12 \cdot P(k-1) \quad (55)$$

Then, the process proceeds to Step 320, where an estimated load torque value $\hat{T}'(k)$ is calculated as shown in the following equation (56) using the result of the calculation in Step 310:

$$\hat{T}'(k) = \hat{C}11 \cdot Z(k) + \hat{D} \cdot 11 \cdot \omega(k)^2 + \hat{D} \cdot 12 \cdot P(k) \quad (56)$$

The procedures carried out in Steps 310 and 320 function in combination as the observer P10 shown in FIG. 5. In the subsequent Step 330, an estimated actual load torque value Tλ(k) is calculated from the estimated load torque value T'(k) calculated in Step 320 as follows:

$$T\lambda(k) = +T'(k) - \beta/\alpha 3 \quad (57)$$

Then, the process proceeds to Step 340, where a first feedback quantity is obtained by multiplying the estimated load torque value T'(k) calculated in Step 320, the rotational speed square value ω(k)2 calculated in Step 140 and the intake pressure P(k) read in Step 130 by the element Fa in the optimal feedback gain Fa', and a control quantity m(k)/ω(k) is calculated by adding a second feedback quantity iea to the first feedback quantity as follows:

$$m(k)/\omega(k) = Fa11 \cdot T'(k) + Fa12 \cdot \omega(k)^2 + Fa13 \cdot P(k) + iea \quad (58)$$

The procedure carried out in Step 340 functions as the linear calculation section P12 shown in FIG. 5.

In the subsequent Step 350, a signal which is equivalent to the estimated actual load torque Tλ(k) calculated in Step 330 is output to the outside through the input-/output section 3e.

The above-described arrangement of the control system provides the advantage that the actual load torque Tλ, which is difficult to measure in practice, can be estimated with a high degree of accuracy, in addition to the advantages of the described embodiment.

Figure 7:
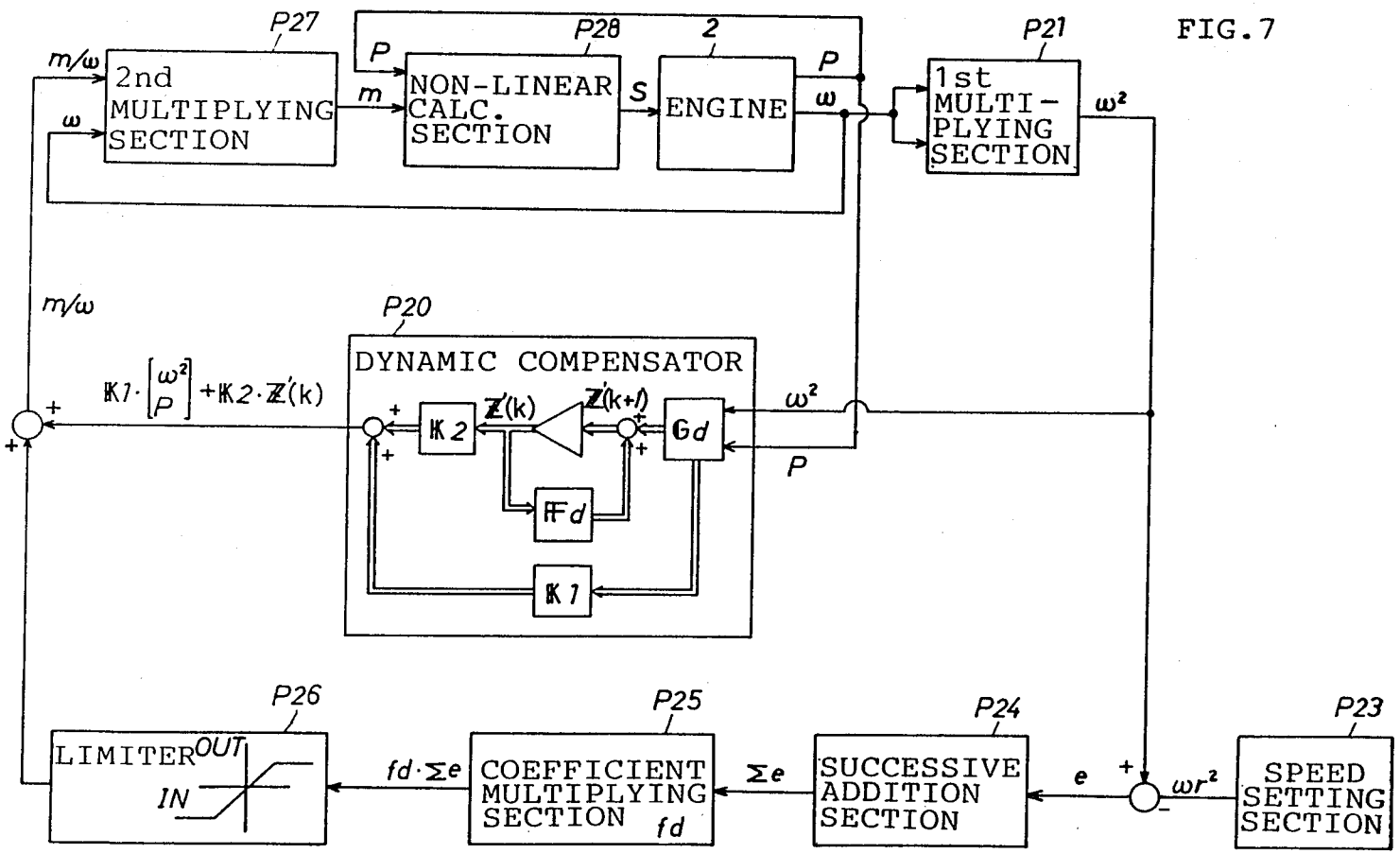
FIG. 7 is a block diagram showing a control system in accordance with still another embodiment of the present invention.

Further, it is also possible to arrange a control system which has a dynamic compensator P20 and which is realized by dynamic feedback using feedback elements which have dynamic characteristics as shown in FIG. 7. The state and output equations of the engine 2 that is the control object in the control system shown in FIG. 7 are as follows:

$$Xd(k+1) = Ad \cdot Xd(k) + Bd \cdot ud(k) \quad (59)$$

$$yd(k) = Cd \cdot Xd(k) \quad (60)$$

The dynamic compensator P20 shown in FIG. 7 may be expressed as follows:

$$Z'(k+1) = Fd \cdot Z'(k) + Gd \cdot yd(k) \quad (61)$$

In consequence, the control quantity m(k)/ω(k) [expressed herein as ud(k) for the sake of convenience] is obtained as follows:

$$ud(k) = K1 \cdot yd(k) + K2 \cdot Z'(k) \quad (62)$$

Thus, if the control system that is expressed by the above equation (59) is controllable and observable, it is possible to specify the poles of the system as desired by using a P-order dynamic compensator. It should be noted that the order P of the dynamic compensator is determined as follows:

$$P = min(\mu - 1, \nu - 1) \quad (63)$$

where μ is a controllable exponent and ν is an observable exponent.

When the above equations (61) and (62) are substituted into the equations (59) and (60) which express the control object, overall characteristics of the control system can be expressed as follows:

$$\begin{bmatrix} Xd(k+1) \\ Z'(k+1) \end{bmatrix} = \begin{bmatrix} Ad + Bd \cdot K1 \cdot Cd & Bd \cdot K2 \\ Gd \cdot Cd & Fd \end{bmatrix} \cdot \begin{bmatrix} Xd(k) \\ Z'(k) \end{bmatrix} \quad (64)$$

In general, in output feedback control the system is not always asymptotically stable. However, employment of a P-order dynamic compensator as described above enables the system to be asymptotically stable at all times. Even when a dynamic compensator the order of which is lower than P-order is employed, it is possible to asymptotically stabilize the system and hence realize effective control. Selection of order for a dynamic compensator is described in detail, for example, in Takashi Tanihagi et al. "Optimal Design of Model Follow-Up Control System" in the Electronic Communication Society Collected Papers (A) [1979] and Takashi Tanihagi et al. "Minimax Design of Model Follow-Up Control System" in the Electronic Communication Society Collected Papers (A) [1981].

Although the present invention has been described by way of some embodiments, it should be noted here that the present invention is not necessarily limited to the described embodiments, and various changes or modifications may, of course, be imparted thereto without departing from the scope of the invention which is limited solely by the appended claims.

What is claimed is:

1. A non-linear feedback controller for an internal combustion engine, the controller determining a control quantity which is feedback-input to the internal combustion engine according to a dynamic physical model of said internal combustion engine, the model being obtained by approximation from an equation of motion of said internal combustion engine and a mathematical formula expressing mass conservation of the quantity of intake air sucked into said internal combustion engine, thereby controlling the rotational speed of said internal combustion engine, said controller comprising:

operating condition detecting means for detecting at least an intake pressure equivalent quantity which is equivalent to an intake pressure of said internal combustion engine and a rotational speed equivalent quantity which is equivalent to a rotational speed of said internal combustion engine;

opening area control means for controlling the opening area of an intake passage of said internal combustion engine in accordance with an external command manipulating quantity;

control means for calculating a control quantity concerned with the control of the opening area of the intake passage of said internal combustion engine from at least the intake pressure equivalent quantity and rotational speed equivalent quantity detected by said operating condition detecting means by using a parameter set on the basis of the dynamic physical model of said internal combustion engine; and compensating means for outputting a manipulating quantity to said opening area controlling means in such a manner that, when the intake pressure equivalent quantity detected by said operating condition detecting means is equal to or less than a critical pressure equivalent quantity, a value which is determined on the basis of the control quantity calculated by said control means and a predetermined constant is defined as a manipulating quantity; whereas, when the intake pressure equivalent quantity exceeds the critical pressure equivalent quantity, a value obtained by compensating said control quantity in accordance with said intake pressure equivalent quantity is defined as a manipulating quantity.

2. A non-linear feedback controller according to claim 1, wherein said opening area controlling means is a throttle valve provided in an intake pipe of the internal combustion engine.

3. A non-linear feedback controller according to claim 1, wherein said opening area controlling means is an idling speed control valve provided in an air passage which bypasses a throttle valve.

4. A non-linear feedback controller according to claim 2 or 3, wherein said operating condition detecting means employs as an intake pressure equivalent quantity a value measured by a pressure gauge provided in the intake pipe of said internal combustion engine at the downstream side of the throttle valve and further employs as a rotational speed equivalent quantity a square of the rotational speed of a crankshaft of said internal combustion engine.

5. A non-linear feedback controller according to claim 1, wherein the control means comprises a linear calculator (P2), the linear calculator being responsive to the pressure equivalent quantity (P) and the rotational speed equivalent quantity ($\omega$) for producing the control quantity which is a quotient ($m/\omega$) of an intake air quantity (m) divided by a rotational speed of the engine ($\omega$).

6. A non-linear feedback controller according to claim 5, wherein the control means further comprises an observer for observing the internal combustion engine, the observer being responsive to the pressure equivalent quantity, the rotational speed equivalent quantity and the control quantity for producing an estimated load torque value (T') to be input into the linear calculator (P12).

7. A non-linear feedback controller according to claim 1, wherein the control means comprises a dynamic compensator (P20), the dynamic compensator being responsive to the pressure equivalent quantity (P) and the rotational speed equivalent quantity ($\omega$) for producing the control quantity which is a quotient ($m/\omega$) of an intake air quantity (m) divided by a rotational speed of the engine ($\omega$).

* * * * *

UNITED STATES PATENT AND TRADEMARK OFFICE

CERTIFICATE OF CORRECTION

PATENT NO. : 4,860,707

DATED : August 29, 1989

INVENTOR(S) : Ohata, A.

It is certified that error appears in the above-identified patent and that said Letters Patent is hereby corrected as shown below:

Column 10, line 42: Change "P" to --P3--.

Column 11, line 62: Change "$\rho$" to --$\rho^0$--.

Column 12, line 13: Change "ve-described" to --above-described--.

Column 12, line 35: Change "te" to --the--.

Column 13, line 57: Change "Ri·Ri" to --Ri·Ti--.

Column 14, line 25: Change "with is" to --with * is--.

Column 15, line 20: Change "obtains" to --obtain--.

Column 18, line 51: Change "calculated" to --e(k) calculated--.

UNITED STATES PATENT AND TRADEMARK OFFICE

CERTIFICATE OF CORRECTION

PATENT NO. : 4,860,707

DATED : August 29, 1989

INVENTOR(S) : Ohata, A.

It is certified that error appears in the above-identified patent and that said Letters Patent is hereby corrected as shown below:

Column 20, line 52: Change "torque value $\hat{T}40$" to --torque value $\hat{T}40$--.

Column 21, lines 44, 68: Change "T" to --$\hat{T}$--.

Column 22, lines 4, 8, 16: Change "T" to --$\hat{T}$--.

Column 24, line 49: Change "T" to --$\hat{T}$--.

Column 21, line 63: Change "$\hat{+}$D." to --$+\hat{D}$.--.

Column 21, line 45: Change "T" to --$\hat{T}$--.

Column 22, line 1: Change "T" to --$\hat{T}$--.

Signed and Sealed this

Fifth Day of March, 1991

*Attest:*

HARRY F. MANBECK, JR.

*Attesting Officer*

*Commissioner of Patents and Trademarks*